US006059964A

United States Patent [19]

Strawser, Sr.

[11] Patent Number: 6,059,964

[45] Date of Patent: May 9, 2000

[54] COLLAPSIBLE CATCH BASIN GRATE FILTER ASSEMBLY

[75] Inventor: Daniel M. Strawser, Sr., Grove City, Ohio

[73] Assignee: Alpine Stormwater Management Company, Grove City, Ohio

[21] Appl. No.: 09/204,834

[22] Filed: Dec. 3, 1998

[51] Int. Cl.[7] ..... E03F 5/00

[52] U.S. Cl. ..... 210/164; 210/166; 210/232; 210/489; 404/4

[58] Field of Search ..... 210/163–166, 210/232, 249, 335, 488, 489; 404/2, 4, 5; 4/289–292; 52/645, 646

[56] References Cited

U.S. PATENT DOCUMENTS 4,376,318 3/1983 Cirillo .
4,988,235 1/1991 Hurley .
5,304,305 4/1994 Lehrer .
5,345,741 9/1994 Slater et al. .
5,368,728 11/1994 Reaves .
5,480,254 1/1996 Autry et al. .
5,672,271 9/1997 Dye .
5,807,415 9/1998 Leo .
5,843,306 12/1998 Singleton .

*Primary Examiner*—David A. Simmons
*Assistant Examiner*—Fred Prince
*Attorney, Agent, or Firm*—Thomas S. Baker, Jr.

[57] ABSTRACT

A novel filter assembly for a drainage system stormwater catch basin is provided with spaced-apart open frame elements that are joined to and carry a singular mesh fabric filter element, and with manually pivotable support leg elements that permit the assembly to be collapsed for subsequent transportation, storage, or refurbishing.

1 Claim, 2 Drawing Sheets

COLLAPSIBLE CATCH BASIN GRATE FILTER ASSEMBLY

CROSS-REFERENCES

None.

FIELD OF THE INVENTION

This invention relates generally to stormwater drainage systems, and particularly concerns an improved filter assembly that may readily and advantageously utilized with a stormwater drainage system catch basin opening to prevent foreign materials from entering the drainage system.

BACKGROUND OF THE INVENTION

Increasingly it becoming necessary, in order to comply with applicable governmental environment regulations, to provide for adequate filtering of debris, silt, and the like from run-off stormwater prior to entry of that run-off water into the stormwater inlets of a constructed drainage system and subsequent flow to a natural drainage system. Such filtering is particularly necessary and important with respect to construction sites having or bounded by hard-surfaced roadways and having inlet openings in the one or more catch basins comprising a part of the stormwater drainage system.

Many different forms of filter devices have been proposed or offered for such applications but have generally been found to be either unnecessarily complex or difficult to utilize—particularly with respect to filter removal and replacement for maintenance cleaning and also with respect to transportation and storage between successive uses. Many such filter device forms have required the prior removal of the usually very heavy cast metal drainage system inlet covers or grates in order to achieve proper filter installation. See for instance the disclosures of U.S. Pat. No. 4,594,157 granted to McGowan, and also U.S. Pat. No. 5,223,154 issued in the names of MacPherson, J. et al.

Other teachings of drainage system inlet filters requiring the removal of inlet covers or grates prior to installation or replacement of the silt and debris filter device include U.S. Pat. No. 5,405,539 issued to Schneider and U.S. Pat. No. 5,575,925 granted to Logue, Jr.

See also U.S. Pat. No. 5,403,474 granted to Emery for disclosure of a stormwater drainage system inlet filter that, while not requiring the prior removal of an inlet opening cover or grate prior to filter installation or replacement, does require the pre-installation manipulation of a metal mesh container filled with large and heavy volumes of gravel.

Another type of stormwater filter device for stormwater drainage system inlet openings is disclosed in U.S. Pat. No. 5,345,741 granted to Slater et al. and, although not requiring removal or replacement of an inlet opening grate or cover, is relatively complex and unnecessarily bulky compared to the invention described and claimed herein.

I have discovered that the shortcomings associated with such prior art may be readily overcome through the use of a novel construction of filter device for stormwater drainage system catch basin inlet opening applications. Other objects and advantages of the present invention will become apparent during a consideration of the descriptions and drawings which follow.

SUMMARY OF THE INVENTION

The stormwater system catch basin filter assembly of the present invention is basically comprised of a pair of spaced apart rectangular metal frame elements sized to be co-extensive in area with co-operating catch basin inlet openings, a singular tube-like and flexible silt and debris filter element secured to both metal frame elements and functioning as a collapsible filter that connects the metal frame elements into a unitary structure, and selectively foldable strut members that are pivotally connected to one of the frame elements and that may be unfolded for engagement with the other of the pair of frame elements to place the collapsible filter element in a relatively taut filtering condition. Separate clamp elements are provided for removably connecting the assembly to a catch basin inlet opening frame.

DETAILED DESCRIPTION

Figure 1:
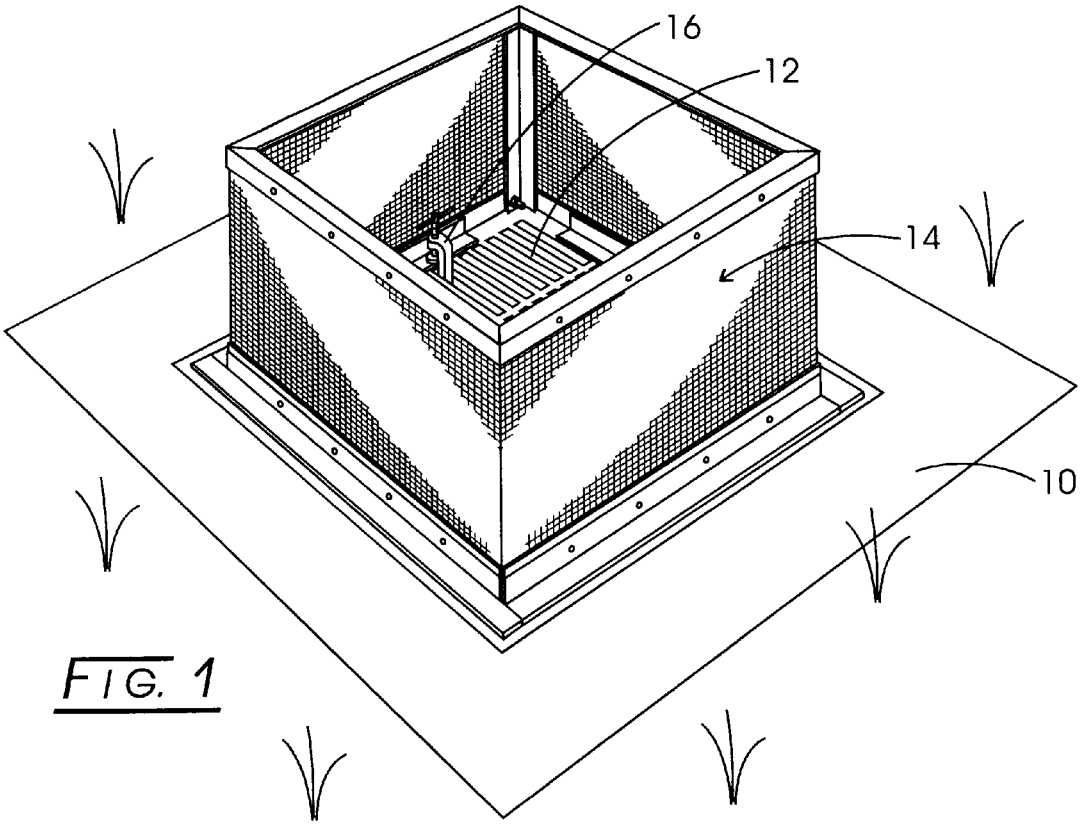
FIG. 1 is a perspective view of a stormwater drainage system catch basin inlet opening having a preferred embodiment of the. filter assembly of the present invention installed thereon.

FIG. 1 illustrates a portion of a typical catch basin inlet 10 having a conventional heavy-duty cast metal (usually a low carbon steel alloy) opening grate 12. Stormwater run-off enters the incorporating stormwater drainage system through opening 12 after flowing through the erect invention filter assembly 14 which preferably secured to opening grate 12 by conventional C-clamp devices 16. See FIG. 3.

Figure 2:
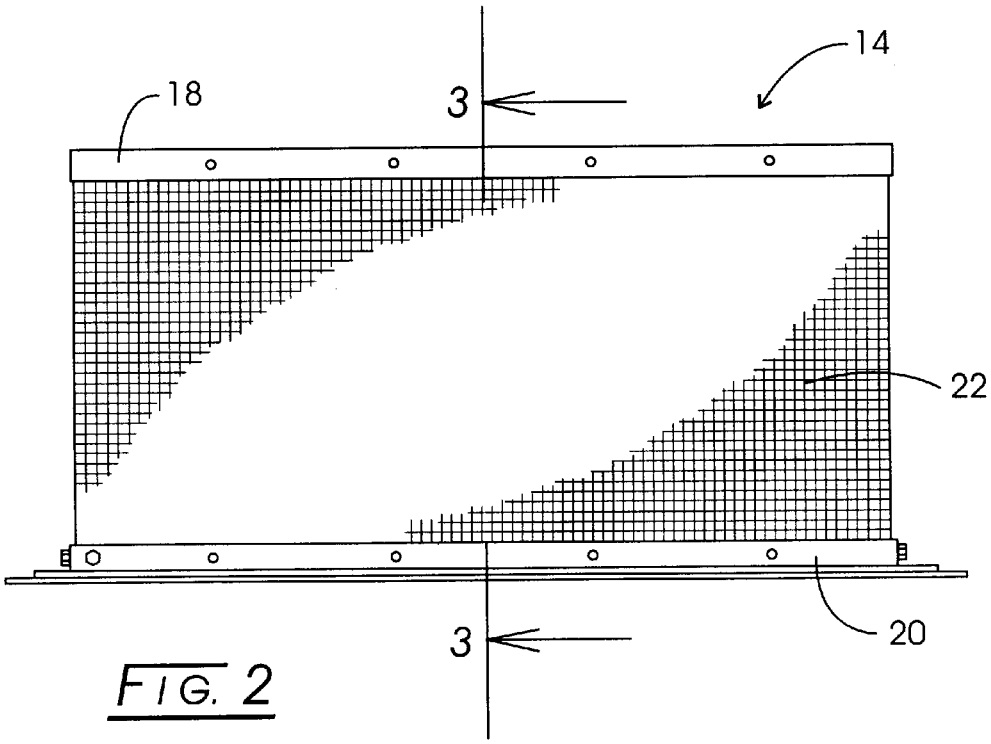
FIG. 2 is an elevation view of the filter assembly of FIG. 1.

As shown in FIG. 2, the filter assembly of the present invention is basically comprised of an upper relatively rigid frame element 18, a lower relatively rigid frame element 20 of similar planform, and a filter element 22 that is a collapsible tube-shaped, mesh filter fabric preferably clamped or clinched and riveted at upper and lower extremes to frame elements 18 and 20. Frame elements 18 and 20 are preferably formed of a stainless steel material. Mesh fabric filter element 22 is preferably fabricated of relatively closely inter-woven polypropylene monofilaments, such filter element has substantial flexibility which permits it to be collapsed and yet function as an integral filter in the region that separates spaced-apart frame elements 18 and 20.

Figure 3:
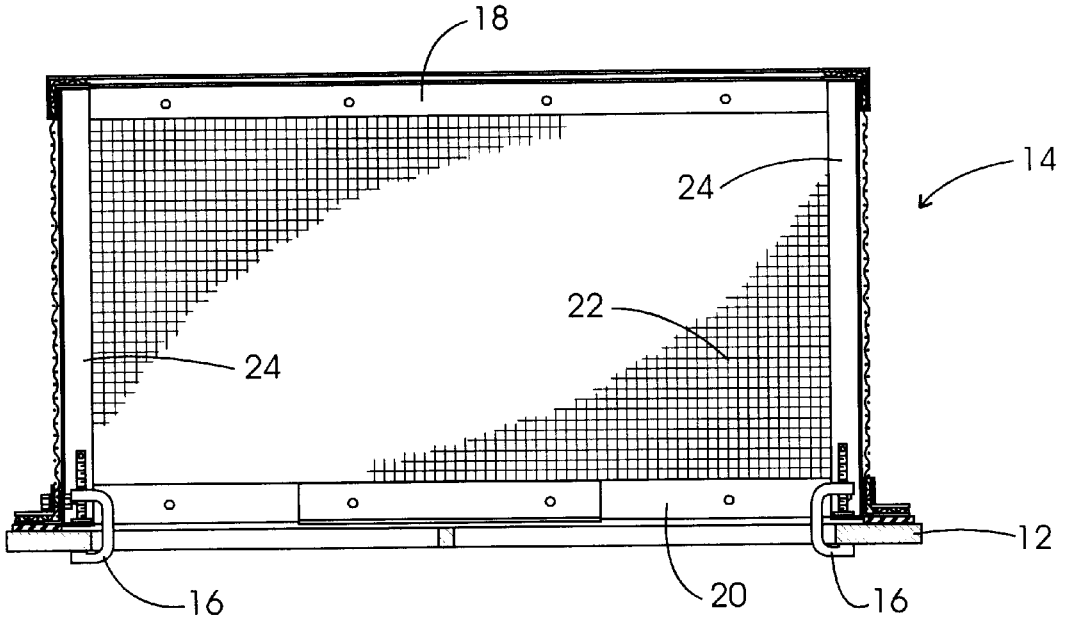
FIG. 3 is a section view taken at line 3—3 of FIG. 2.
Figure 4:
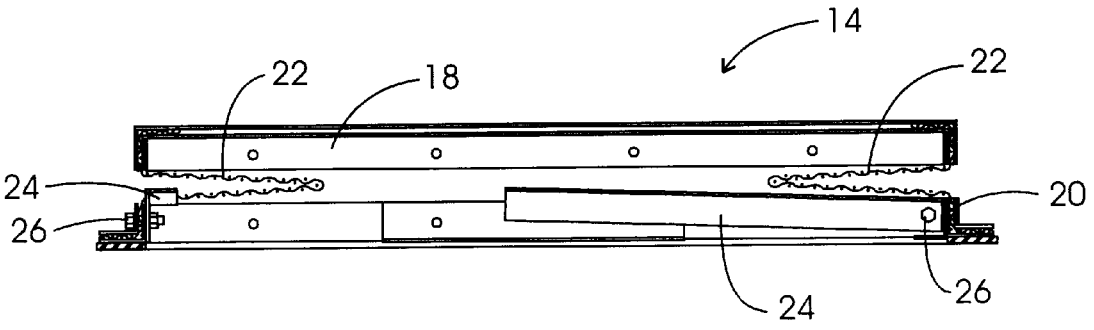
FIG. 4 is a section view similar to FIG. 3 but showing the filter assembly in its collapsed condition ready for transportation and/or storage between uses.

The preferred embodiment filter assembly is also provided with four leg elements 24 that are each pivotally connected to one of frame elements 18 and 20, preferably lower frame element 20 as shown in FIGS. 3 and 4, by suitable rivet fasteners 26 or the like. When rotated to a vertical condition, each leg element supports the other frame element (element 18 in FIG. 3) to place fabric filter element 22 in a taut condition so that it will function as an effective stormwater filter.

When removal of filter assembly 14 is required or is desired, as for replacement, cleaning, or subsequent re-use, it becomes necessary to first remove catch basin cover grate element 18 from within its grate support 12 before such operations can be completed. Then, generally support leg elements 24 are rotated to their horizontal or collapsed condition thereby permitting fabric filter element 22 to also be collapsed to place assembly 14 in its FIG. 4 condition.

Various changes may be made with respect to the shapes, sizes, and construction materials of the disclosed elements of the stormwater catch basin filter assembly of the present invention without departing from the scope, meaning, or intent of the claim which follows.

I claim as my invention:

1. For combination with a stormwater catch basin having an opening grate, a catch basin filter assembly comprising:

a lower rigid rectangular open frame element having a plan area substantially co-extensive with the plan area of the stormwater catch basin opening grate;

an upper rigid rectangular open frame element having a plan area substantially co-extensive with the plan area of said lower rigid rectangular open frame element;

a collapsible mesh fabric filter tube element connected to and carried at its opposite extremes by said lower and upper rigid rectangular open frame elements; and multiple support leg elements each pivotally connected to one of said lower and upper rigid rectangular open frame elements and each rotatable from a collapsed condition to an erected condition, said multiple support leg elements contacting the other of said lower and upper rigid rectangular open frame elements and placing said collapsible mesh fabric filter tube element in a taut condition when pivoted to said erected condition.

* * * * *